US005782157A

United States Patent [19]

Ellington et al.

[11] Patent Number: 5,782,157

[45] Date of Patent: Jul. 21, 1998

[54] CHUTING ASSEMBLY FOR AMMUNITION MAGAZINE FEED

[75] Inventors: Thomas W. Ellington, Alton; Edward V. Carter, Edwardsville, both of Ill.

[73] Assignee: Esco Electronics Company, St. Louis, Mo.

[21] Appl. No.: 832,382

[22] Filed: Apr. 2, 1997

[51] Int. Cl.[6] ..... F41A 9/30; F41A 9/34

[52] U.S. Cl. ..... 89/33.16; 193/25 AC; 42/1.02

[58] Field of Search ..... 89/33.16, 33.14, 89/33.25, 33.17; 193/25 AC; 42/1.02

[56] References Cited

U.S. PATENT DOCUMENTS

| | | | |
|---|---|---|---|
| 2,379,185 | 6/1945 | Reek | 89/33.17 |
| 2,428,594 | 10/1947 | Thomas et al. | 89/33.16 |
| 2,456,618 | 12/1948 | Carless | 89/33.16 |
| 2,484,104 | 10/1949 | Lippert | 89/33.16 |
| 2,757,576 | 8/1956 | Chapman | 89/33.16 |
| 2,873,649 | 2/1959 | Maillard | 89/33.25 |
| 2,936,677 | 5/1960 | Vickers | 89/33.16 |
| 4,338,851 | 7/1982 | Bremer et al. | 193/25 AC |
| 5,299,487 | 4/1994 | Bertiller et al. | 89/33.14 |

FOREIGN PATENT DOCUMENTS

| | | | |
|---|---|---|---|
| 2948685 | 6/1981 | Germany | 89/33.14 |
| 781748 | 8/1957 | United Kingdom | 89/33.14 |

OTHER PUBLICATIONS

Aciation, Mar./1945, pp. 136 and 138–140, 89/33.14.

Flight, Feb./1943, pp. 125–126, 89/33.14.

*Primary Examiner*—Stephen M. Johnson

[57] ABSTRACT

A storage and feed mechanism (10) stores ammunition (A) for a weapon (W) and facilitates feeding the ammunition to the weapon during firing. A magazine (12) comprises a storage chamber located adjacent the weapon and capable of storing a plurality of rounds of the ammunition. Individual rounds of ammunition are linked together on an ammunition belt (B) which carries the rounds to the weapon during firing. An ammunition feed (32) includes an inlet chute (33a) positioned above the magazine and allowing linked rounds of ammunition to be vertically extracted from the magazine thereby preventing tip-over and similar problems. The feed further includes a fixed fan section (32a) comprising a rigid chute through which the belt of ammunition is drawn. A sprocket drive (62) includes an appropriate gear (64) which engages the ammunition belt to draw the linked ammunition from the magazine up through the chute to the receiver. Use of the rigid chute minimizes resistance to movement of the ammunition belt and eliminates jams caused by belt stretching, and enables ammunition to be fed to the weapon regardless of the weapon's angle of elevation during firing.

29 Claims, 5 Drawing Sheets

CHUTING ASSEMBLY FOR AMMUNITION MAGAZINE FEED

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

This invention relates to the feeding of ammunition from a magazine of a weapon to the weapon, and more particularly, to an improved feed assembly which eliminates feed problems caused by the relative motion of a weapon to the magazine as well as tip-over which produces ammunition jamming in the magazine. The improved feed assembly further improves reloading times, and decreases the susceptibility of the mechanism to damage, all of which effect performance of the weapon particularly in combat situations.

It is not uncommon in military applications for a large caliber weapon (25–30 mm., for example) to have an associated magazine for storing a substantial quantity of ammunition used by the weapon. The magazine is attached to a gun feeding mechanism by which the stored ammunition is drawn from the magazine and fed to the weapon. This allows for a rapid fire weapon to be efficiently supplied with ammunition without the need of a loader or other personnel to be constantly tending the weapon.

Ammunition stored in such magazines is linked ammunition. That is, individual rounds are joined together on a belt. When the ammunition is loaded into the magazine, one end of the belt is rested on the floor of the magazine. The ammunition is then arranged in layers in the magazine, and the other end of the belt is fitted into the gun feeding mechanism. Heretofore, ammunition has been extracted from the magazine by drawing the belt horizontally or diagonally through an opening at one corner of the magazine. The feeding mechanism attached to the magazine employs a feed chute by which the ammunition exiting the magazine is guided toward the weapon and properly oriented for loading into the weapon. As the weapon is fired, links of the ammunition belt are indexed through the feeding mechanism with one layer of ammunition after another being successively withdrawn from the magazine and fed to the weapon.

The current arrangement has a number of problems. A major problem is that the weapon and its respective feed chute are rotated in elevation through an angle of greater than ninety degrees (−15° to +75° plus tolerances). The requirement to rotate the weapon relative to the ammunition magazine has been the weapon designer's nemesis prior to this invention. This relative motion of the weapon to the magazine has required the utilization of a flexible feed chute system. To solve this problem, many existing chuting systems are formed of highly flexible chutes. These are not only expensive, but are also not particularly sturdy. In addition to being easily torn or bent, they also present substantial running resistance to the ammunition being drawn through the chute.

Another problem is that when belted ammunition is loaded into a magazine, the belt is arranged in layers, one layer atop another. During subsequent movement of the gun platform on which the weapon and magazine are mounted, "tip-overs" can occur which cause misfeeding of ammunition. Tip-overs result because the projectile portion of a round is substantially heavier than the shell portion thereof. When there is jostling, the tip end of a round on one layer may tip-over (turn nose down) and cause that round to become enmeshed with the ammunition on the layer below. Now, as the ammunition is fed to the weapon, the two layers become interlocked with each other and this prevents the rounds from being extracted from the magazine. An armourer or other weapons personnel must then undo the two layers so normal feeding can resume. In a combat situation, an occurrence of this type can have fatal consequences.

Other problems occur because it is often difficult to tell when the weapon is about to draw the last round of ammunition from the magazine so preparations can be made to reload the magazine in a timely manner. An unloaded weapon in a combat situation is essentially useless. Moreover, it is important for a gun crew to know when their ammunition supply is substantially depleted so they can use their remaining ammunition prudently until the weapon can be reloaded.

BRIEF SUMMARY OF THE INVENTION

Among the several objects of the present invention may be noted the provision of an ammunition storage and feed mechanism for use with a weapon in which ammunition fired by the weapon is belted ammunition which is fed to the weapon by drawing the ammunition belt from the magazine and feeding it through a chute to the weapon;

the provision of such a mechanism in which the feed mechanism comprises a fixed fan chute which is traversed by the belted ammunition as it is automatically fed to the weapon;

the provision of such a mechanism in which the chute is a rigid chute that presents minimal running resistance to belted ammunition being fed through the chute for ammunition to be efficiently routed to the weapon for firing irrespective of the elevational angle to which the weapon is rotated, and regardless of the movement of the weapon through a range of elevational angles during firing;

the provision of such a mechanism wherein the chute provides a vertical feed of belted ammunition from the magazine, such a vertical feed eliminating "tip-over" and similar problems which either produce or cause misfeeding of ammunition or a complete stoppage of ammunition flow;

The provision of such a mechanism for properly orienting the belted ammunition as it feeds from the magazine to the weapon to facilitate movement of the ammunition to the weapon even if the weapon has a very high firing rate and consumes ammunition rapidly;

the provision of such a mechanism to conveniently store a substantial amount of belted ammunition for the weapon and to include a last round switch capability to timely inform a gun crew when the ammunition supply is low so ammunition can be timely and speedily replenished, as well advise the crew operating the weapon to deplete the remaining rounds of ammunition in a judicious manner so to provide sufficient defense for the craft on which the weapon is mounted to protect the craft while the ammunition is being replenished;

the provision of such an ammunition storage and feed mechanism to enable quick and easy loading and reloading of the weapon, and to eliminate ammunition trays, indexing, and precise counting of ammunition during reloading;

the provision of such a mechanism to have a lightweight yet rugged construction, and to withstand harsh operating environments, and high levels of vibration, yet still efficiently feed ammunition to the weapon;

the provision of such a mechanism which can be used by itself or dually with a similar mechanism for a weapon;

the provision of such a mechanism which does not inhibit ready access to the receiver of the weapon, for ease of weapon maintenance, and allows direct visibility of safety critical weapon status indicators;

the provision of such a mechanism which provides a different ammunition storage capacity depending upon the caliber of weapon with which the mechanism is used; and, the provision of such an ammunition storage and feed mechanism which is relatively low cost, yet provides an easy to use and efficient method of readily supplying a weapon with ammunition.

In accordance with the invention, generally stated, a magazine and feed mechanism stores ammunition for a weapon and facilitates feeding of the ammunition to the weapon when it is fired. The magazine comprises a storage chamber located in proximity to the weapon and capable of storing a substantial number of rounds of ammunition for the weapon. Individual rounds of ammunition are linked together on a belt which carries the rounds to a receiver of the weapon during firing. The feed portion of the mechanism includes a feed chute positioned above the magazine so linked rounds of ammunition can be vertically extracted from the magazine. The feed chute is a rigid chute and has a fixed fan radius section through which the belt of ammunition is drawn. A sprocket drive engages the ammunition belt to draw the linked ammunition from the magazine through the chute and to the weapon. Use of a rigid feed chute as part of the feed solves the problem of supplying ammunition to a weapon having relative motion to the magazine. Vertical extraction of ammunition from the magazine helps to eliminate tip-over problems with the ammunition and also helps prevent jamming of the weapon during firing caused by misalignment of the links of the ammunition and stretching of the ammunition belt. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
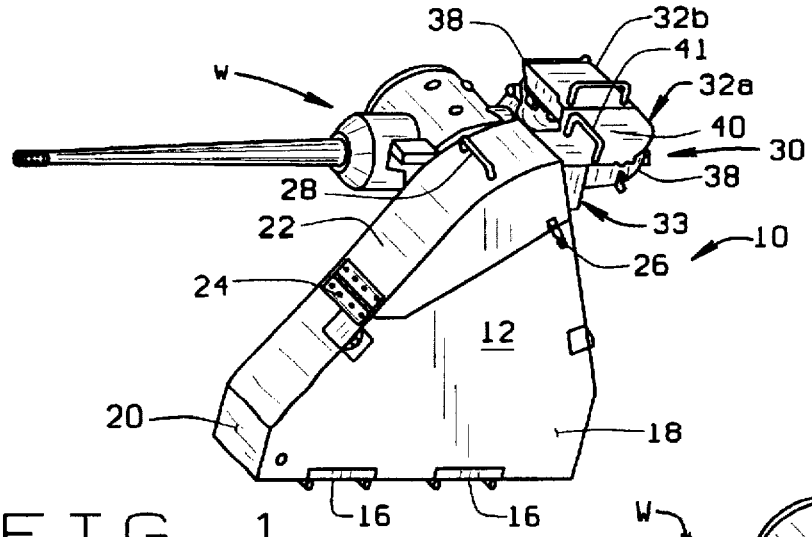
FIG. 1 is a perspective view of a weapon and an ammunition feed and storage mechanism of the present invention.
Figure 2:
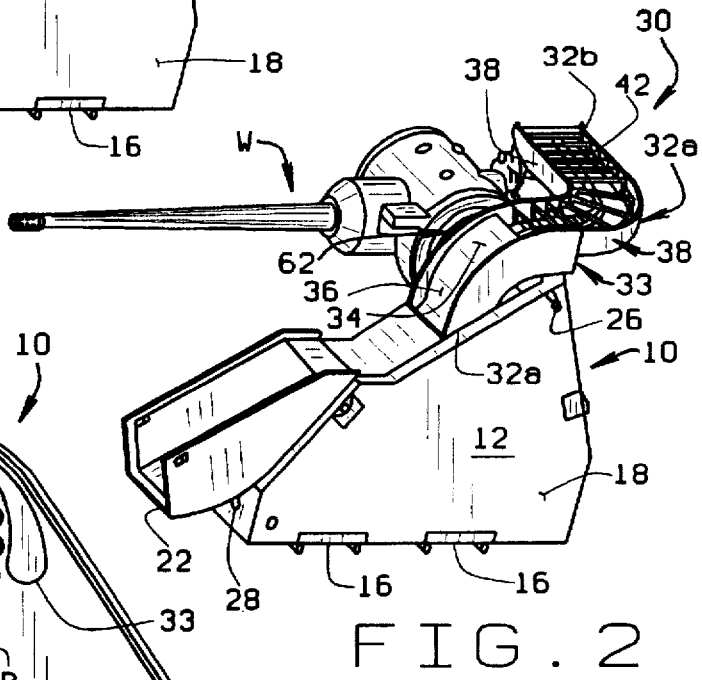
FIG. 2 is a view similar to FIG. 1 but with various hatches shown in their open position and their covers removed.

Referring to the drawings, a magazine and feed mechanism of the present invention is indicated generally 10. The mechanism is for storing belted ammunition A for a weapon W and for feeding the belted ammunition to the weapon when the weapon is fired. Although the mechanism is shown in FIGS. 1 and 2 as being used with a model M242 cannon, it will be understood that the mechanism may be used with a variety of weapons (25–30 mm. caliber weapons) to which belted ammunition is fed and that the type of weapon forms no part of this invention. Similarly, it will be understood that the platform upon which the weapon and mechanism 10 are supported may be any of a variety of platforms without departing from the scope of the invention. Thus, for example, the weapon may be mounted on a craft such as a wheeled vehicle or tank, a helicopter or other aircraft, or a ship. In each instance, the mechanism facilitates storage of ample quantities of ammunition for the weapon, and efficiently and reliably feeds the belted ammunition to the weapon with no misfeeds and no jamming.

Mechanism 10 first includes a magazine means 12 which is located in proximity to weapon W. Although magazine 12 is shown located to one side of weapon W, the magazine can be located to either side of the weapon, as circumstances warrant, and will work equally as well regardless of the direction from which ammunition is fed into the weapon. The magazine is made of a lightweight, composite material, and has a flat base 14 which is readily installed in mounts 16 by which the magazine is supported in place on a weapons platform (not shown). The magazine has sidewalls 18 and endwalls 20. The endwalls each have a vertical lower section and an upper inwardly sloping section as shown in the drawings. The width of the magazine is slightly wider than the length of a round of ammunition stored in the magazine. The storage capability of the magazine is, for example, up to 350 rounds of ammunition. For the cannon shown in FIGS. 1 and 2, the storage capacity is somewhat less, being on the order of 275 rounds.

Figure 3:
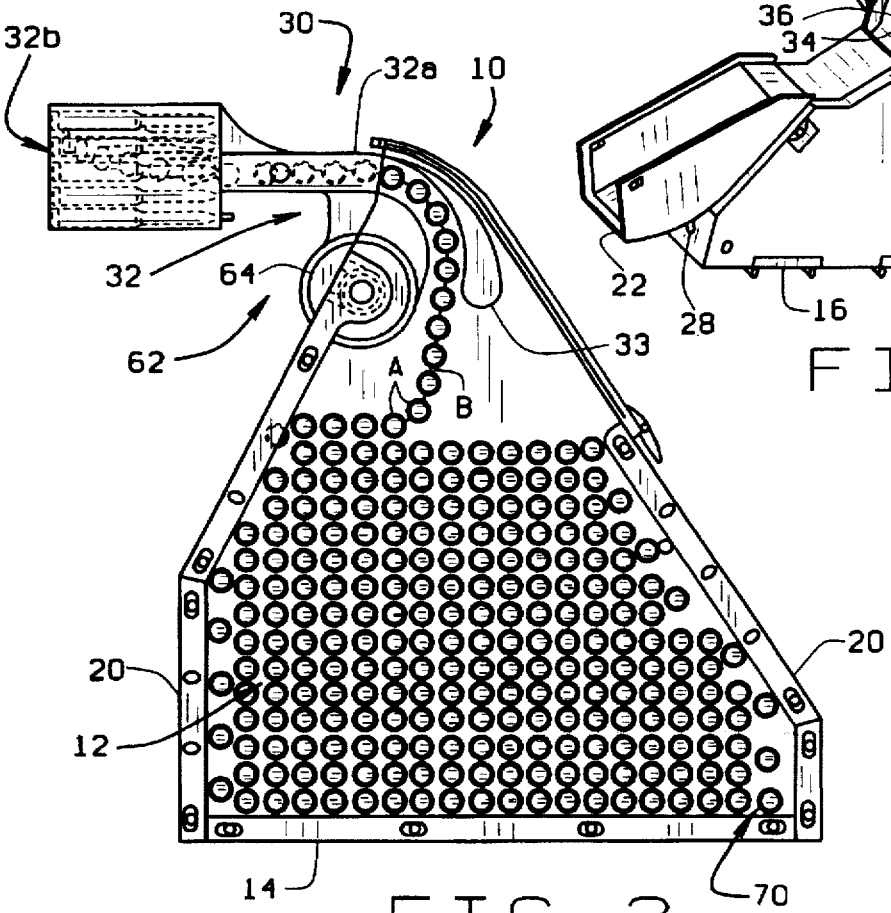
FIG. 3 is a side elevational view, in section, of an ammunition storage and feed mechanism of the invention.
Figure 6:
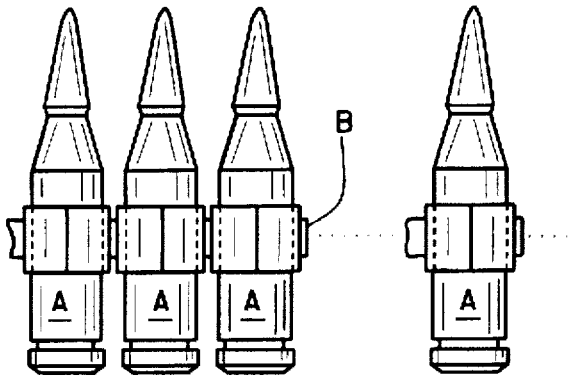
FIG. 6 is a plan view of belted rounds of ammunition such as are stored in the magazine.

As shown in FIG. 6, individual rounds A of ammunition are linked together on an ammunition belt B. The belt is of a spring steel construction and comprises opposed sections each forming a semicircle into which rounds of ammunition are inserted. When the ammunition is loaded into the magazine, the belt is layered back and forth in a serpentine fashion on the floor of the magazine so that layers such as shown in FIG. 3 are formed. For clarity purposes, the arrangement of the belted ammunition in the magazine is shown in simplified form in this drawing figure. As is described hereinafter, the belt is fed from the magazine to a receiver (not shown) of weapon W during firing. The magazine includes a hinged cover 22 (see FIGS. 1 and 2) which is hingedly mounted to one endwall 20 of the magazine by a hinge 24. A latch member or clasp 26 is mounted on a sidewall 18 of the magazine to latch the cover in its closed position shown in FIG. 1. When the latch is released, grasping a handle 28 on the cover allows an armourer ready access to the magazine for loading a belt of ammunition into it. The cover is then closed and latched in place.

The magazine and feed mechanism next includes a feed means indicated generally 30. The feed means allows the belted ammunition to be drawn from the magazine and routed to a receiver of the weapon. The feed means includes a feed chute 32 which is centrally positioned above magazine 12 and allows the linked rounds of ammunition to be vertically extracted over a cylindrical surface from the magazine. This provides a drum shaped surface for the ammunition belt to be drawn over as it is vertically lifted out of the magazine regardless of the weapon elevation angle. The drum shaped surface is coaxial with, and rotates equally with, the weapon's elevation. The tangency point of contact of the belted ammunition to the drum shaped surface generally does not move relative to the magazine throughout the range of weapon elevation. Therefore the flow of ammunition is vertical without imparting a horizontal component of motion. This ensures the exiting of rounds on subsequent layers of static rounds. The vertical lifting of the ammunition out of the magazine regardless of weapon elevation position further ensures reliable flow of ammunition into the feed chute at all firing positions. All relative motion of the feed chute to the magazine occurs as rotation of the drum shaped surface about the weapon elevation axis. Feed chute 32 is a rigid feed chute having a fixed fan radius through which the ammunition is drawn. The feed chute has two sections 32*a*, 32*b*. An inlet 33 to the rigid feed chute allows an ammunition belt to be pulled vertically upward out of the magazine rather than being drawn out diagonally or horizontally as in conventional feed arrangements. Section 32*a* is a fixed fan radius section. In it, the belted ammunition is channeled from a feed direction extending generally parallel to the axis of the bore of the weapon, to a direction orthogonal thereto. This allows the ammunition to be readily fed into a receiver of the weapon for firing. Further, after the ammunition is drawn through this fixed fan section, it enters section 32*b* of the rigid feed chute where it is elevated from a generally horizontal plane to one which places the ammunition above the receiver. This enables the ammunition to be fed vertically downwardly into the receiver. In both sections 32*a* and 32*b*, the change in direction of orientation of the ammunition is approximately 90°. Importantly, the rigid feed chute is not fixed relative to the magazine. Rather, it rotates in a synchronized and coaxial manner with the weapon as the weapon is elevated or depressed. The outlet end of the feed chute is securely attached to the weapon's receiver/feeder mechanism while the inlet end of the feed chute is pinned to the outlet of the magazine so to be coaxial with the weapon. The ammunition feeds vertically from the magazine outlet into the feed chute. The inlet of the feed chute is of a cylindrical shape and has an inside radius concentric to the weapon's elevation axis. Vertical lifting of ammunition through a centralized vertical exit of the magazine eliminates entanglement of rounds due to "tip-over." This has been a formidable problem in previous magazine and feed system designs.

Inlet 33 to the chute has side plates 34 which form curved sidewalls. These plates, in conjunction with a face plate or front plate 36 define a lower inlet end and an upper outlet end. As viewed in FIG. 2, inlet 33 to the rigid feed chute allows the belted ammunition to move vertically upwardly over a drum shaped surface, regardless of weapon elevation, as it enters the chute. As the ammunition moves through the chute, it also moves rearwardly (as viewed in FIG. 2), so when the ammunition exits the inlet it is moving parallel to, and toward, the rear of the weapon. Frontplate 36 covers the upwardly moving ammunition and has a curved surface corresponding to the curvature of the sideplates. This section 33 of the feed means is enclosed by both the side walls of the magazine, and magazine cover 22. The outlet end of this section also extends rearwardly of the magazine as viewed in FIGS. 1 and 2.

Figure 7:
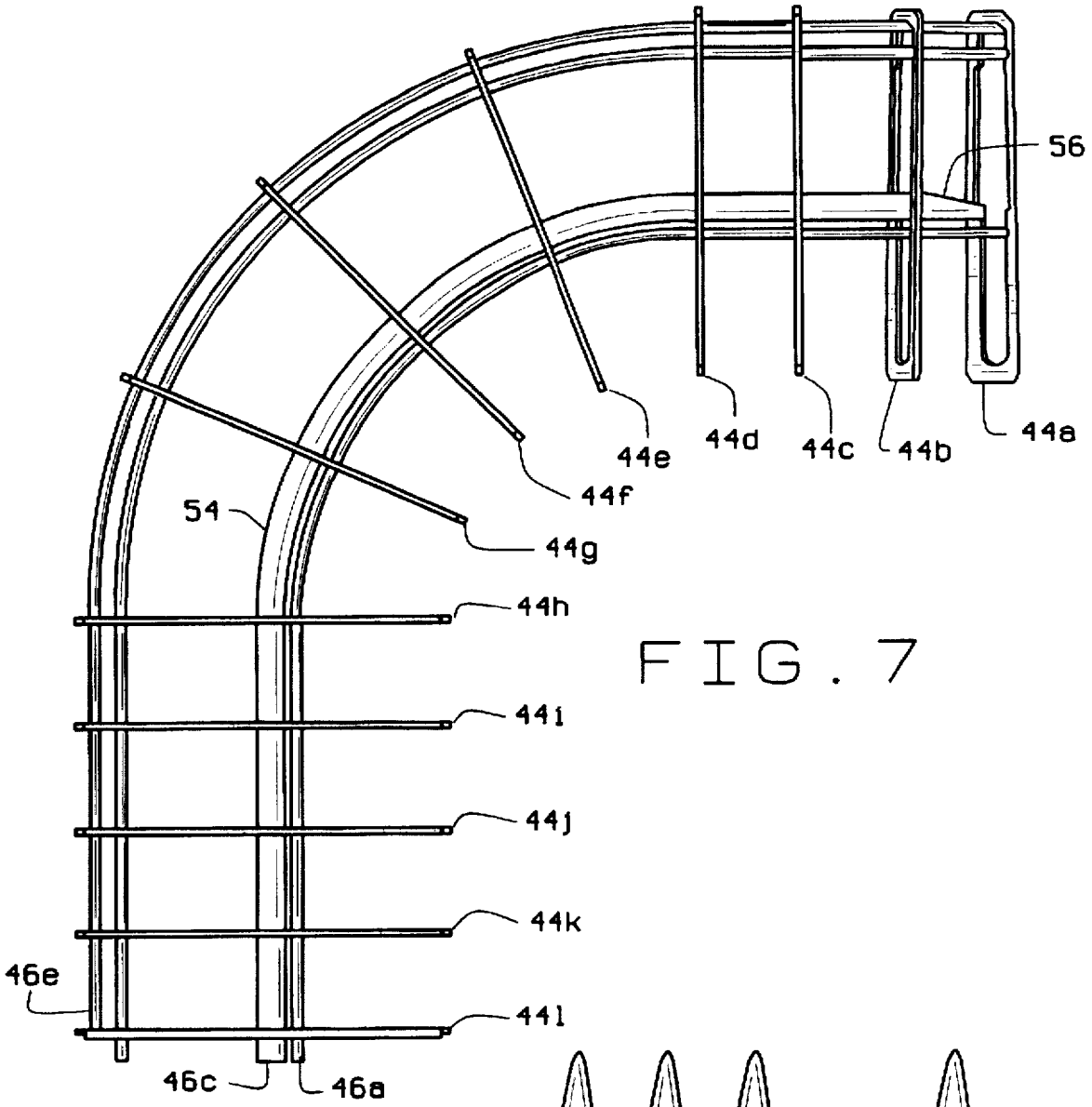
FIG. 7 is a plan view of a fixed fan portion of a feed chute of the mechanism.
Figure 10:
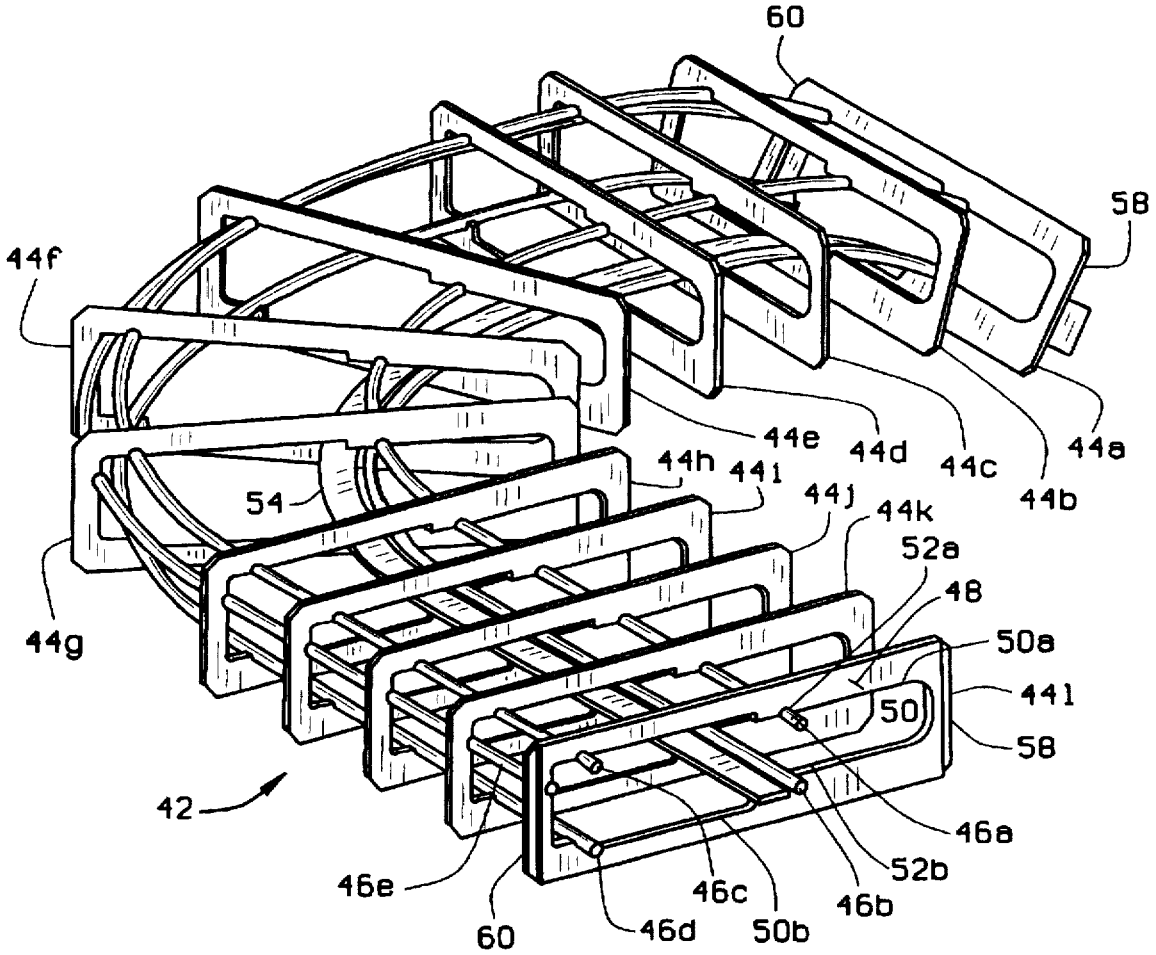
FIG. 10 is perspective view of the chute assembly.

Next, section 32*a* of the rigid feed chute houses the fan portion of the feed by which the ammunition withdrawn from the magazine is redirected toward the weapon. Section 32*a* includes curved side walls 38 and a removable cover 40 which enclose a fixed fan assembly 42. Cover 40 is conveniently latched in place in the same manner as cover 22, and is removable using a handle 41. The fan assembly comprises a plurality of spaced frame members 44*a*–44*l* all of which are rigidly interconnected using a plurality of spaced rods 46*a*–46*e*. As shown in FIGS. 7 and 10, fan assembly 42 not only serves to feed the ammunition to the weapon, but also channels the ammunition from a direction extending generally parallel to the bore of the weapon, to one in which the ammunition is moving orthogonally to the weapon. This change in direction of ammunition movement is shown in the drawings to be approximately 90°. In FIG. 7, guide frames 44*a*–44*d* are positioned parallel to one another and evenly spaced apart. The next four ribs 44*e*–44*h* are each rotated 22 ½° with respect to each other so to provide the appropriate change in direction of feed. Finally, the remaining four ribs 44*i*–44*l* are also positioned parallel to one another. The result is a fan shaped chute assembly that allows a desired traverse of the belted ammunition from the inlet of the chute toward the weapon to be accomplished. It will be understood that there could be more or fewer guide frames than are shown in the drawings without departing from the scope of the invention. For example, if the magazine were located farther away from the weapon than shown in FIGS. 1 and 2, the chute assembly would have to be correspondingly longer. Again, the rigid feed chute pivots coaxial to and synchronized with the weapon.

Figure 9A:
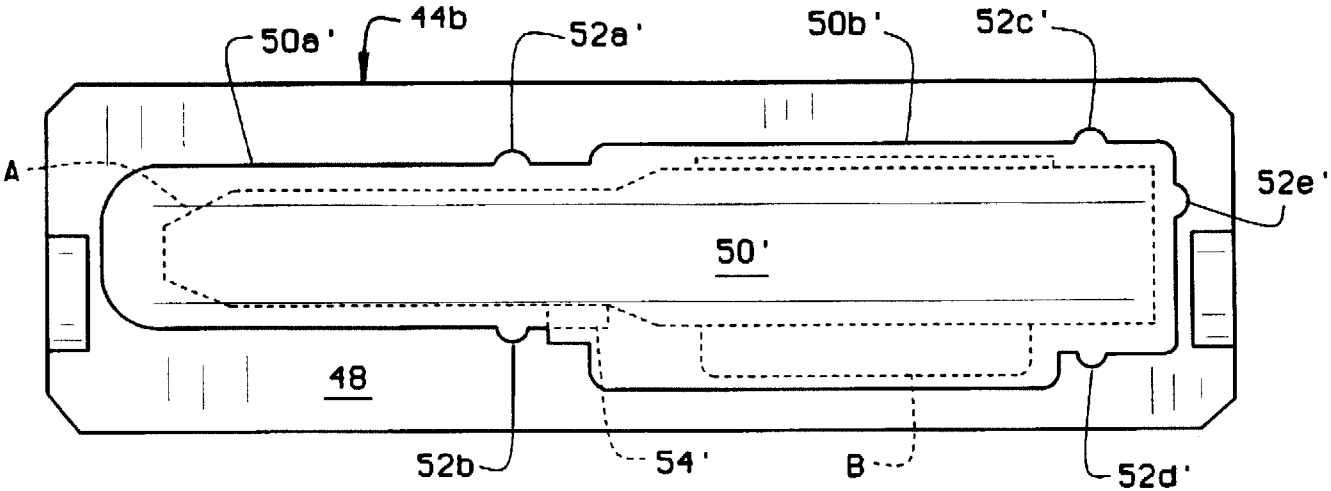
FIG. 9A is a front elevational view of a guide frame used in the middle portion of the chute assembly.
Figure 9B:
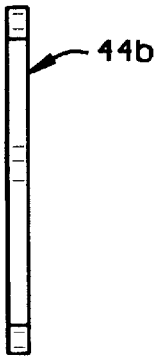
FIG. 9B is a side elevational view thereof.
Figure 8A:
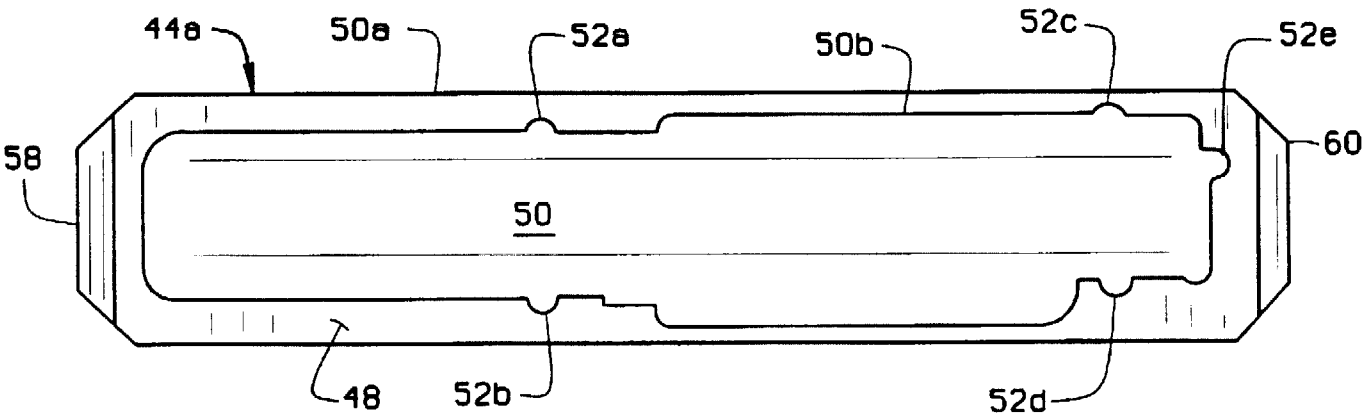
FIG. 8A is a front elevational view of an end guide frame for a chute assembly.
Figure 8B:
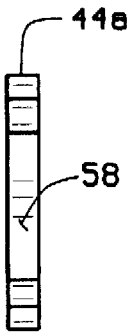
FIG. 8B is a side elevational view thereof.

In FIGS. 8A–9B, respective end and intermediate guide frames 44 are shown. End guide frame 44*a* is shown in FIGS. 8A and 8B, and intermediate guide frame 44*b* is shown in FIGS. 9A and 9B. Because the respective end and intermediate frames are similar in construction, the reference characters used to describe each are the same except that those associated with the intermediate frame also have a designation. As shown in these drawings, each guide frame is formed of a generally rectangular metal plate 48 the corners of which are beveled at an approximately 45° angle. Each guide frame further has an elongate slot or cutout indicated generally 50. Slot 50 has extends generally the width of plate 48 and has respective first and second sections 50*a*, 50*b*. Section 50*a* is shorter in both width and height than section 50*b*. As shown in FIG. 9A, a round of ammunition A is shown in phantom as the round would look in passing through the guide frame. It can be seen that the projectile portion of the round passes through the smaller section 50*a* of the slot, while the shell or casing portion of the round passes through the larger section 50*b* thereof. The belt B by which the rounds are carried also passes through section 50*b* of the slot. Section 50*a* has respective notches 52*a*, 52*b* formed therein in the upper and lower reaches of the slot near the transition from section 50*a* to section 50*b*. The respective rods 46*a*, 46*b* fit into these notches and are attached to the guide frame by welding or other suitable form of attachment. Similarly, there are respective notches 52*c*, 52*d* formed in the upper and lower reaches of slot section 50*b*. These notches are formed in the guide frame near the end of the slot adjacent the side of the guide frame. Respective rods 46*c*, 46*d* fit into these notches and, again, are appropriately attached to the guide frame. Finally, a notch 52*e* is formed in the endwall of slot 50*b*. Rod 46*e* is fitted into this notch. By constructing the fan assembly as described, a rigid structure is formed defining a chute through which the ammunition is routed. The rigidity of this construction further minimizes resistance to ammunition movement, as well prevents jamming which result from belt stretch, for example.

Besides the rods, the chute assembly additionally includes an elongate, flat plate 54 having a curvature corresponding to that of the chute assembly. Plate 54 extends the length of the assembly with one end of the plate being attached to frame guide 44*a* at the one end, and to frame guide 44*l* at the other end. The end of the plate adjacent end guide frame 44*a* is beveled, as indicated at 56, so as to be less wide at the inlet end to the fan assembly. As shown in FIG. 9A, there is a shelf formed in the guide at the juncture between slot sections 50*a*, 50*b*. The underside of plate 54 rests upon this shelf and the plate is attached to each guide frame member. The shelf provides a track support for the rounds of ammunition being delivered through the fan assembly. As such, it helps insure that the ammunition moves smoothly through the assembly and jamming does not occur. Each of the end guide frames 44*a*, 44*l* has a projection or tab 58, 60 extending outwardly from the sides of the guide frames. These tabs are received in appropriate slots (not shown) in the sidewalls 38 of section 32*a*, so to mount the fan assembly in the place. This tab construction further permits ready removal of the fan assembly for repair or replacement.

Figure 4:
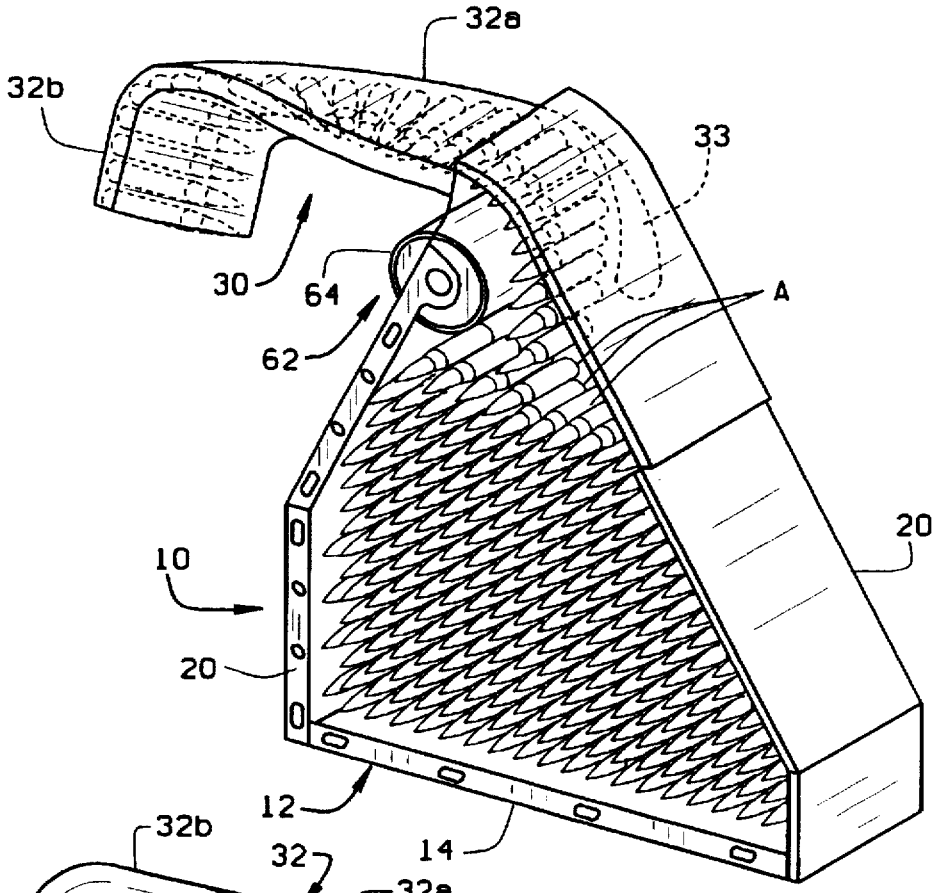
FIG. 4 is a perspective view of the ammunition storage and feed mechanism.
Figure 5B:
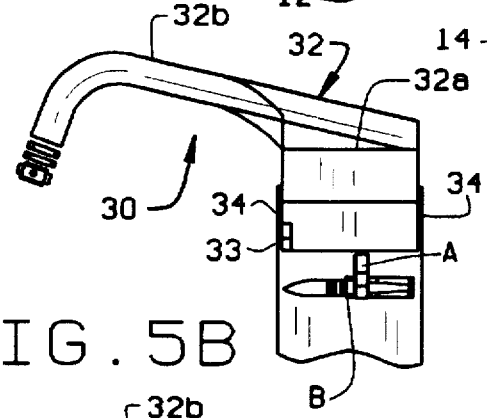
FIGS. 5B and 5C are respective rear and side elevational views of the chute.
Figure 5C:
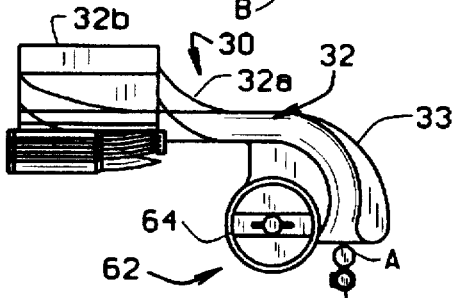
Figure 5A:
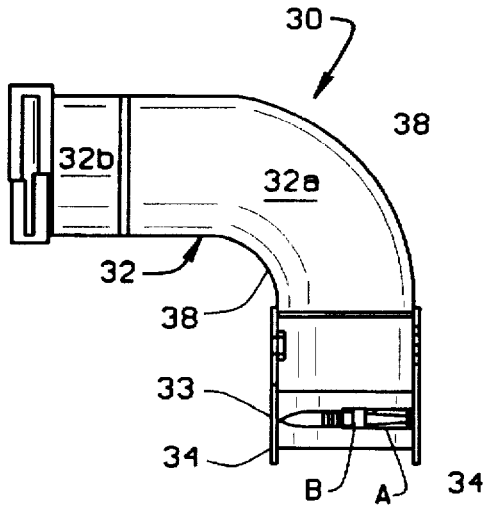
FIG. 5A is a bottom plan view of a rigid ammunition feed chute of the mechanism.

After reaching the end of chute assembly section 32*a*, the rounds of ammunition next enter section 32*b*. Here, and as shown in FIGS. 3 and 4, the ammunition path is such that it first is elevated above the level of ammunition drawn through section 32*a* and then moves vertically downwardly into a receiver section (not shown) of weapon W. At the receiver, individual rounds of ammunition are separated from the belt to which they are attached, with the belt segments being discarded. The rounds are then loaded into the firing chamber of the weapon, all as is well known in the art, and fired at a target. As best shown in FIG. 5B, it can be seen that the fan assembly is installed on an incline in which ammunition exiting the assembly has been elevated to a height above that at which the rounds enter the assembly.

Apparatus 10 next includes a drive means 62 for engaging the belt of ammunition. The drive means includes a sprocket gear assembly 64 one end of which is connected to the feed mechanism of the weapon, and the other end of which is located between inlet 33 and section 32*a* of the rigid feed chute. The gear assembly 64 is installed on the underside of the chute assembly. After a belt of ammunition has been fitted into magazine 12, the outer, free end of the belt is drawn up into inlet 33. A tooth of a sprocket gear engages the belt so that when the gear is rotated by the feed mechanism of the weapon, successive teeth on the gear engage links of the belt to draw the linked ammunition from the magazine up and through the rigid chute. The belt of ammunition is drawn through all the rigid feed chute so the round on the end of the belt is loaded into the weapon. This allows the weapon to commence firing at a target whenever it is activated.

The operation of the drive means commences immediately upon the firing system for the weapon being engaged. Regardless of the firing rate of the weapon, so long as the weapon is being fired, rounds of ammunition are extracted from magazine 10, routed through chute 32, and delivered to the weapon. It is a feature of the invention to incorporate a last round sensing means 70 into the magazine. This capability allows a signal to be provided to the control system governing weapon firing to provide a timely indication that the weapon will soon need to be reloaded. Sensing means 70 can be effected in a variety of ways within the scope of the present invention. For example, a pressure switch (see FIG. 3) may extend upwardly from the floor of the magazine into the interior of the magazine. When a belt of ammunition is loaded into the magazine, a round of ammunition in the bottom layer depresses the switch. As the ammunition is fired, successive layers of ammunition are withdrawn from the magazine. As the last round of ammunition on the belt clears the switch, it returns back to its unloaded position. This change in position produces a "last round" signal to the gun crew so they know a reloading operation is imminent and can begin preparations for it. The location of the switch on the floor of the magazine is immaterial. The important thing is that the last round of ammunition clear the switch as the bottom layer of rounds are withdrawn.

Alternate sensing means may also be employed to achieve the same result. For example, an optical sensor can be located at the base of the magazine with the optical path between a light source and detector being blocked so as a round of ammunition rests upon the floor of the magazine. As the bottom layer is withdrawn and clears the magazine floor, the optical path is restored; again producing a "last round" signal to be acted upon by the gun crew to replenish the magazine.

What has been described is an ammunition storage and feed mechanism for use with a belt fed weapon. The feed portion of the mechanism employs a fixed fan chute traversed by belted ammunition as it is automatically fed to the weapon. The chute is a rigid chute securely attached to the weapon and pivoted at the exit of the magazine coaxial to the weapon elevation axis and as such alleviates or eliminates various ammunition feed problems which cause firing stoppages of the weapon. The chute allows for vertical withdrawal of belted ammunition over a drum shaped surface generally concentric to the weapon elevation axis from a storage chamber of a magazine, and this vertical feed arrangement reduces or eliminates entanglement of the rounds due to tip over or similar feed problems with the ammunition that otherwise might cause a firing stoppage. The magazine is used to store ammunition and conveniently stores up to 350 rounds of belted ammunition. A last round switch capability is provided to sense when the magazine is substantially empty, thus to facilitate timely reloading of the weapon. The ammunition storage and feed mechanism of the invention enables quick and easy loading and reloading of the weapon, and eliminates ammunition trays, indexing, and precise counting of ammunition during reloading. The mechanism is of a lightweight, rugged construction capable of withstanding harsh operating environments while maintaining its capability of efficiently feeding ammunition to the weapon. The mechanism can be used singly, or two similar mechanisms can be provided for the weapon. Also, the mechanism allows ready access to the weapon for maintenance purposes and the mechanism does not interfere with an operator's direct visibility of the weapon's safety critical status indicators. The mechanism provides different storage capabilities depending upon the caliber of the weapon with which it is employed, and the mechanism provides a low cost, easy to use system for efficient operation of the weapon.

Importantly, the chute construction employs a series of guide frames through which the ammunition is channeled, the guide frames having slotted openings for this purpose. The guide frames are all interconnected by a series of rods. A plate extending the length of the chute assembly provides support for the rounds of ammunition traversing the assembly.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A magazine and feed mechanism storing ammunition for a weapon and feeding the ammunition to the weapon when the weapon is fired comprising:

a magazine storing a plurality of rounds of ammunition, individual rounds of said ammunition being linked together on an ammunition belt by which said rounds of ammunition are fed to the weapon during firing;

feed means including a feed chute positioned above said magazine vertically extracting said linked rounds of ammunition from said magazine, said feed chute being a rigid feed chute having a fixed fan radius through which said belt of ammunition is drawn;

drive means engaging said belt of ammunition to draw said linked ammunition from said magazine up through said rigid chute to the weapon, use of said rigid chute enabling ammunition to be fed to the weapon regardless of the weapon's angle of elevation and eliminating feed problems caused by tip-over of the belted ammunition which may otherwise stop the weapon from firing and jamming of the weapon during firing due to misalignment of links of the ammunition and stretching of the ammunition belt; and, a switch within said magazine actuated by movement of the last of round of ammunition on a belt from its storage position in the magazine to provide an indication thereof and facilitate reloading of the magazine.

2. The magazine and feed mechanism of claim 1 wherein said magazine includes a storage chamber in which said belt of link ammunition is arranged in layers in a predetermined pattern to facilitate feed of the ammunition from the chamber to the weapon.

3. The magazine and feed mechanism of claim 2 further including a removable cover for accessing said storage chamber to load a belt of linked rounds of ammunition into said chamber.

4. The magazine and feed mechanism of claim 1 wherein said fixed feed chute has a first and generally vertical section having an inlet attached to an ammunition feed outlet of said magazine, and a generally horizontal section through which a belt of ammunition traverses from said vertical section to a receiver of said weapon.

5. The magazine and feed mechanism of claim 4 wherein said generally horizontal section of said fixed feed chute includes a bend for changing the orientation of said rounds of ammunition as the ammunition belt feeds through said horizontal section.

6. The magazine and feed mechanism of claim 4 wherein said feed chute comprises a plurality of spaced guide frames each of which has an opening therein sized for a round of belted ammunition to feed through the opening.

7. The feed mechanism of claim 6 wherein said feed chute further includes a plurality of rods extending through and between each of said guide frames, said guide frames being attached to said rods to form a chute assembly.

8. The feed mechanism of claim 7 further including first and second plates respectively defining sidewalls of said chute, wherein said guide frames at the respective ends of said chute assembly include means for attachment thereof to said sidewalls to mount said assembly in said chute, and said opening in each guide frame being a slot having respective first and second slot sections, one of said slot sections being sized for the projectile portion of the round to pass therethrough, and the other of said sections being sized for the casing portion of the round to pass therethrough, and support means extending the length of said chute and through said second slot section of each said guide frame to support the rounds of ammunition as they traverse said chute.

9. The magazine and feed mechanism of claim 8 wherein one end of said horizontal section of said fixed feed chute is elevated with respect to the other end thereof, said elevated end being the end of said horizontal section from which said ammunition feeds into the receiver of said weapon.

10. The magazine and feed mechanism of claim 4 wherein said drive means includes a sprocket gear driven by firing of said weapon, said sprocket gear engaging said ammunition belt to move said rounds of ammunition from said magazine to said weapon, and a support means including a plate extending the length of said chute assembly and attached to said guide frames to support said rounds of ammunition as they are drawn through said chute assembly when said drive means is activated and a gear of said sprocket gear engages a link of said belt.

11. The magazine and feed mechanism of claim 10 wherein said sprocket gear is positioned adjacent said vertical section of said fixed feed, and said vertical section has an opening therein through which said sprocket gear engages said ammunition belt to move said rounds of ammunition from said magazine into said vertical section of said chute.

12. The magazine and feed mechanism of claim 11 further including removable cover means fitting over said respective vertical and horizontal sections of said fixed feed chute for accessing said ammunition belt, each said cover means including a hinged cover, handle means for moving the cover to open and close the sections of the feed chute, and latch means for latching the covers in their closed positions.

13. The magazine and feed mechanism of claim 1 wherein said magazine includes an outlet at an upper end of said magazine, and said fixed feed chute includes a first section and a second section, said first section being a generally vertical feed section one end of which connects to said outlet in said magazine means, and said second section being a generally horizontal section one end of which connects with the other end of said first section and the other end of which is an outlet of said feed means by which said rounds of ammunition are directed into a receiver of said weapon, each of said first and second sections being curved sections the curvature of which enables the belt of ammunition to first gradually change from a vertical to a horizontal direction, and then to change from a direction extending generally parallel to said weapon to a direction in which said belt is directed to said receiver.

14. The magazine and feed mechanism of claim 13 wherein said second section of said fixed feed chute slopes upwardly from said end connecting with said other end of said first section to a location adjacent said outlet end of said second section, said second section sloping downwardly from said location to said outlet end of said second section for said rounds of ammunition directed into said receiver of said weapon to be delivered generally vertically into said receiver.

15. A feed mechanism for use with a magazine storing ammunition used by a weapon, the magazine storing a plurality of individual rounds of ammunition linked together on an ammunition belt by which the rounds are fed to a receiver of the weapon during firing; the feed mechanism feeding the ammunition from the magazine to the weapon when the weapon is fired, regardless of the weapon's angle of elevation, or changes thereto, during firing, the feed mechanism comprising:

a feed chute positioned above said magazine for vertically extracting said linked rounds of ammunition from said magazine, said feed chute being a rigid feed chute having a fixed fan radius through which said belt of ammunition is drawn, said fixed feed chute having a generally vertical section with an inlet attached to an ammunition feed outlet of the magazine and a generally horizontal section through which a belt of ammunition traverses from said vertical section to the receiver of the weapon, said generally horizontal section including a bend for changing the orientation of said rounds of ammunition as the ammunition belt feeds through said horizontal section, said feed chute comprising a plurality of spaced guide frames each of which has an opening therein sized for a round of belted ammunition to feed through the opening, said opening being a slot having respective first and second slot sections, one of said slot sections being sized for the projectile portion of the round to pass therethrough, and the other of said sections being sized for the casing portion of the round to pass therethrough;

support means extending the length of said chute and through said second slot section of each said guide frame to support the rounds of ammunition as they traverse said chute; and, drive means engaging said belt of ammunition to draw said linked ammunition from said magazine through said rigid chute to the receiver of said weapon, use of said rigid chute enabling ammunition to be fed to the weapon regardless of its angle of elevation during firing.

16. The feed mechanism of claim 15 wherein said feed chute further includes a plurality of rods extending through and between each of said guide frames, said guide frames being attached to said rods to form a chute assembly, and said support means includes a plate extending the length of said chute assembly and attached to aid guide frames to support said rounds of ammunition as they are drawn through said chute assembly when said drive means is activated and engages links on said ammunition belt.

17. The feed mechanism of claim 16 further including first and second plates respectively defining sidewalls of said chute, wherein said guide frames at the respective ends of said chute assembly including means for attachment thereof to said sidewalls.

18. The feed mechanism of claim 15 wherein one end of the horizontal section of said fixed feed chute is raised with respect to the other end thereof, said raised end being the end of the horizontal section from which ammunition feeds into the receiver of the weapon.

19. The feed mechanism of claim 15 wherein said drive means includes a sprocket gear driven by firing of the weapon, said sprocket gear engaging said ammunition belt to move said rounds of ammunition from the magazine to the weapon.

20. The mechanism of claim 19 wherein said sprocket gear is positioned adjacent said vertical section of said fixed feed, and said vertical section has an opening therein through which said sprocket gear engages said ammunition belt to move said rounds of ammunition from the magazine into said vertical section of the chute.

21. The feed mechanism of claim 20 further including sensing means responsive to the placement of a belt of ammunition in said magazine and the movement of the last round of ammunition on said belt as said round is extracted from said magazine to provide an indication to an operator of said weapon that the ammunition therefor needs replenishment.

22. The feed mechanism of claim 17 wherein said generally horizontal section of said fixed feed chute slopes upwardly from an end connecting with another end of said generally vertical section to a location adjacent an outlet end of said generally horizontal section, said generally horizontal section sloping downwardly from said location to said outlet end of said generally horizontal section for rounds of ammunition directed into the receiver of the weapon to be delivered generally vertically into the receiver.

23. A feed mechanism for use with a magazine storing ammunition used by a weapon, the magazine storing a plurality of individual rounds of ammunition linked together on an ammunition belt by which the rounds are fed to a receiver of the weapon during firing; the feed mechanism feeding the ammunition from the magazine to the weapon when the weapon is fired, the feed mechanism comprising:

a feed chute positioned above said magazine to extract linked rounds of ammunition vertically from said magazine, said feed chute being a rigid feed chute having a fixed fan radius section through which said belt of ammunition is drawn by a drive mechanism which engages the ammunition belt and draws the linked ammunition through the chute from the magazine to the receiver of the weapon, said rigid feed chute properly orienting and maintaining the belted ammunition for feeding to the weapon regardless of the weapon's elevation at the time of firing, said fixed feed chute having a generally vertical section with an inlet attached to an ammunition feed outlet of the magazine, and a generally horizontal section through which a belt of ammunition traverses from said vertical section to the receiver of the weapon, said generally horizontal section including a 90° bend for redirecting rounds of ammunition as the belt feeds through said horizontal section, one end of the horizontal section being raised with respect to the other end thereof, said raised end being the end of the horizontal section from which ammunition feeds into the receiver of the weapon; and, a removable cover fitting over said respective vertical and horizontal sections of said fixed feed chute for accessing the ammunition belt.

24. The feed mechanism of claim 23 wherein said feed chute comprises a plurality of spaced guide frames each of which has an opening therein sized for a round of belted ammunition to feed through the opening, said opening being a slot having respective first and second slot sections, one of said slot sections being sized for the projectile portion of the round to pass therethrough, and the other of said sections being sized for the casing portion of the round to pass therethrough, and support means extending the length of said chute and through said second slot section of each said guide frame to support the rounds of ammunition as they traverse said chute.

25. The feed mechanism of claim 24 wherein said feed chute further includes a plurality of rods extending through and between each of said guide frames, said guide frames being attached to said rods to form a chute assembly, and said support means includes a plate extending the length of said chute assembly and attached to said guide frames to support said rounds of ammunition as they are drawn through said chute assembly when said drive means is activated and engages links on said ammunition belt.

26. The feed mechanism of claim 25 further including first and second plates respectively defining sidewalls of said chute, wherein said guide frames at the respective ends of said chute assembly including means for attachment thereof to said sidewalls to mount said assembly in said chute.

27. In an ammunition feed mechanism for feeding rounds of ammunition linked together on a belt from a magazine in which ammunition is stored to a receiver of a weapon through which the rounds are fired; the improvement comprising a fixed feed chute positioned above the magazine for vertically extracting said linked rounds of ammunition from said magazine, said feed chute being a rigid feed chute including a plurality of spaced guide frames each of which has an opening therein sized for a round of belted ammunition to feed through the opening, said opening being a slot having respective first and second slot sections, one of said slot sections being sized for the projectile portion of the round to pass therethrough, and the other of said sections being sized for the casing portion of the round to pass therethrough, and support means extending the length of said chute and through said second slot section of each said guide frame to support the rounds of ammunition as they traverse said chute, a plurality of rods extending through and between each of said guide frames, said guide frames being attached to said rods to form a chute assembly, and first and second plates respectively defining sidewalls of said chute, said guide frames at the respective ends of said chute assembly including means for attachment thereof to said sidewalls to mount said assembly in said chute, said chute assembly having a fixed fan radius through which said belt of ammunition is drawn by a drive mechanism which engages the ammunition belt and draws the linked ammunition vertically into the chute from the magazine so to feed ammunition to the weapon irrespective of the weapon's angle of elevation during firing and to eliminate ammunition tip over which prevents ammunition discharge from the magazine and stops the feed of ammunition to the weapon, and sensing means responsive to the placement of a belt of ammunition in said magazine and the movement of the last round of ammunition on said belt as said round is extracted from said magazine to provide an indication to an operator of said weapon that the ammunition therefor needs replenishment.

28. A feed mechanism for use with a magazine storing ammunition used by a weapon, the magazine storing a plurality of individual rounds of ammunition linked together on an ammunition belt by which the rounds are fed to a receiver of the weapon during firing; the feed mechanism feeding the ammunition from the magazine to the weapon when the weapon is fired, regardless of the weapon's angle of elevation, or changes thereto, during firing, the feed mechanism comprising:

a feed chute positioned above said magazine for vertically extracting said linked rounds of ammunition from said magazine, said feed chute being a rigid feed chute having a fixed fan radius through which said belt of ammunition is drawn, said fixed feed chute having a generally vertical section with an inlet attached to an ammunition feed outlet of the magazine and a generally horizontal section through which a belt of ammunition traverses from said vertical section to the receiver of the weapon;

drive means engaging said belt of ammunition to draw said linked ammunition from said magazine through said rigid chute to the receiver of said weapon, use of said rigid chute enabling ammunition to be fed to the weapon regardless of its angle of elevation during firing, said drive means including a sprocket gear driven by firing of the weapon and engaging said ammunition belt to move said rounds of ammunition from the magazine to the weapon, said sprocket gear being positioned adjacent said vertical section of said fixed feed, and said vertical section has an opening therein through which said sprocket gear engages said ammunition belt to move said rounds of ammunition from the magazine into said vertical section of the chute; and, sensing means responsive to the placement of a belt of ammunition in said magazine and the movement of the last round of ammunition on said belt as said round is extracted from said magazine to provide an indication to an operator of said weapon that the ammunition therefor needs replenishment.

29. A feed mechanism for use with a magazine storing ammunition used by a weapon, the magazine storing a plurality of individual rounds of ammunition linked together on an ammunition belt by which the rounds are fed to a receiver of the weapon during firing; the feed mechanism feeding the ammunition from the magazine, which has an outlet at an upper end thereof, to the weapon when the weapon is fired, regardless of the weapon's angle of elevation, or changes thereto, during firing, the feed mechanism comprising:

a feed chute positioned above said magazine for vertically extracting said linked rounds of ammunition from said magazine, said feed chute being a rigid feed chute having a fixed fan radius through which said belt of ammunition is drawn, and the feed chute including a first section and a second section, said first section being a generally vertical feed section one end of which connects to the outlet of the magazine, and said second section being a generally horizontal section one end of which connects with the other end of said first section and the other end of which is an outlet of said feed means by which said rounds of ammunition are directed into said receiver of the weapon, each of said first and second sections being curved sections the curvature of which enables the belt of ammunition to first gradually change from a vertical to a horizontal direction, and then to change from a direction extending generally parallel to the weapon to a direction in which the belt is directed to the receivers and said second section of said fixed feed chute slopes upwardly from said end connecting with said other end of said first section to a location adjacent said outlet end of said second section, said second section sloping downwardly from said location to said outlet end of said second section for rounds of ammunition directed into the receiver of the weapon to be delivered generally vertically into the receiver; and, drive means engaging said belt of ammunition to draw said linked ammunition from said magazine through said rigid chute to the receiver of said weapon, use of said rigid chute enabling ammunition to be fed to the weapon regardless of its angle of elevation during firing.

* * * * *

UNITED STATES PATENT AND TRADEMARK OFFICE

CERTIFICATE OF CORRECTION

PATENT NO. : 5,782,157

DATED : July 21, 1998

INVENTOR(S) : Thomas W. Ellington et al.

It is certified that error appears in the above-identified patent and that said Letters Patent is hereby corrected as shown below:

Column 6, Line 39, before "designation" insert -- ' --; and

IN THE CLAIMS:

Column 14, line 48, change "receivers" to -- receiver,--

Signed and Sealed this

Thirteenth Day of October 1998

*Attest:*

Bruce Lehman

BRUCE LEHMAN

*Attesting Officer*

*Commissioner of Patents and Trademarks*